US007387214B1

(12) United States Patent
Shingle

(10) Patent No.: US 7,387,214 B1
(45) Date of Patent: Jun. 17, 2008

(54) CLOSURE AND CONTAINER PACKAGE WITH CHILD-RESISTANT AND NON-CHILD-RESISTANT MODES OF OPERATION

(75) Inventor: John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 482 days.

(21) Appl. No.: 10/952,144

(22) Filed: Sep. 27, 2004

(51) Int. Cl.
*B65D 55/02* (2006.01)
*B65D 41/06* (2006.01)

(52) U.S. Cl. ..... 215/222; 215/206; 215/209; 215/332; 215/217; 215/230; 220/300

(58) Field of Classification Search ..... 215/217–222, 215/332, 43–45, 230, 203, 201, 213, 334, 215/228, 321, 206, 209; 206/459.5; 220/300
See application file for complete search history.

(56) References Cited

U.S. PATENT DOCUMENTS

| | | | | |
|---|---|---|---|---|
| 3,216,600 | A * | 11/1965 | Dreps | 215/230 |
| 3,809,276 | A * | 5/1974 | Landen | 215/332 |
| 3,991,895 | A * | 11/1976 | Thornton | 215/211 |
| 4,059,198 | A | 11/1977 | Mumford | |
| 4,119,232 | A * | 10/1978 | Thornton | 215/222 |
| 4,153,172 | A * | 5/1979 | Bialobrzeski | 215/209 |
| 4,223,795 | A | 9/1980 | Akers | |
| 4,739,890 | A | 4/1988 | Cooke | |
| 5,449,078 | A * | 9/1995 | Akers | 215/222 |
| 5,464,110 | A | 11/1995 | Heyworth | |
| 5,826,738 | A | 10/1998 | Minh | |
| 5,829,609 | A * | 11/1998 | Beck | 215/217 |
| 5,899,348 | A | 5/1999 | Konefal et al. | |

(Continued)

FOREIGN PATENT DOCUMENTS

EP 0217630 A2 4/1987

(Continued)

OTHER PUBLICATIONS

U.S. Appl. No. 10/684,724, filed Oct. 13, 2003 Title: Closure and Container Package with Child-Resistant and Non-Child-Resisdent Modes of Operation.

*Primary Examiner*—Robin Hylton
(74) *Attorney, Agent, or Firm*—Reising, Ethington, Barnes, Kisselle, P.C.

(57) ABSTRACT

A package includes a closure for attachment to a container. The closure has a skirt with a plurality of internal lugs and an internal surface. The container has a sidewall terminating in an open end and having a plurality of external projections. The plurality of external projections include sets of child-resistant and non-child-resistant projections. The child-resistant projections have undersides with notches for receiving the plurality of internal lugs of the closure, and the non-child-resistant projections have substantially flat undersides for locating against the plurality of internal lugs of the closure. The sidewall also has an external surface located axially between the plurality of external projections and the open end for engagement with the internal surface of the closure for sealing the package and for resiliently biasing the closure away from the container. Preferably, indicia are provided on the closure and container to facilitate selective engagement of the lugs and projections in the different modes.

4 Claims, 1 Drawing Sheet

U.S. PATENT DOCUMENTS

| | | | | |
|---|---|---|---|---|
| 6,039,195 | A | 3/2000 | Konefal et al. | |
| 6,161,711 | A | 12/2000 | Miceli et al. | |
| 6,327,770 | B1 | 12/2001 | Konefal et al. | |
| 6,439,409 | B1 | 8/2002 | Dressel et al. | |
| 6,446,823 | B2 | 9/2002 | Miceli et al. | |
| 6,523,709 | B2 | 2/2003 | Miceli et al. | |
| 6,612,450 | B1 | 9/2003 | Buono | |
| 7,165,692 | B2 * | 1/2007 | Konefal et al. | 215/220 |
| 2001/0035388 | A1 | 11/2001 | Miceli et al. | |
| 2002/0084239 | A1 | 7/2002 | Dressel et al. | |
| 2002/0195412 | A1 | 12/2002 | Miceli et al. | |
| 2003/0075519 | A1 | 4/2003 | Miceli et al. | |
| 2005/0263477 | A1 * | 12/2005 | Konefal et al. | 215/228 |

FOREIGN PATENT DOCUMENTS

| | | | |
|---|---|---|---|
| GB | 2137601 | A | 10/1984 |
| GB | 2164325 | A | 3/1986 |

* cited by examiner

CLOSURE AND CONTAINER PACKAGE WITH CHILD-RESISTANT AND NON-CHILD-RESISTANT MODES OF OPERATION

The present invention relates to closure and container packages, such as prescription packages for example, and more specifically to closure and container packages, and closures and containers for such packages, that have child-resistant and non-child-resistant modes of operation.

Reference is made to U.S. application Ser. No. 10/684,724 assigned to the assignee of the present application.

BACKGROUND AND SUMMARY OF THE INVENTION

U.S. Pat. Nos. 4,057,159, 4,059,198 and 4,485,932 disclose child-resistant closure and container prescription packages that include a container or vial, a closure, and a spring/seal disk arrangement disposed between the closure and the container. The closure has lugs on an inside surface of a skirt that cooperate with external locking notches or pockets on projections around the mouth of the container for securing the closure to the container. An internal abutment on the closure cooperates with the spring/seal disk(s) to urge the closure away from the container so that the lugs are resiliently captured within the notches. When it is desired to remove the closure, the closure is pushed toward the container so that the lugs clear the notches, and then turned counterclockwise. When the closure is assembled to the container, the lugs cam beneath surfaces on the projections against the force of the spring seal disk(s) until the lugs snap into the notches on the projections.

Although the closure and container packages disclosed in the noted patents have enjoyed substantial commercial acceptance and success, improvements remain desirable. For example, it can be difficult for adults with impaired dexterity to push and twist the closure with respect to the container to open the package for access to the contents. Some prior art packages have both a child-resistant mode of operation and a non-child-resistant mode of operation, wherein the closure must be inverted, or flipped upside down, and re-applied to the container in the non-child-resistant mode of operation. This inversion of the closure on the container often yields a package having a different appearance in the non-child-resistant mode than in the child-resistant mode.

A package in accordance with a first aspect of the invention includes a closure having a skirt with a first plurality of lugs, a container having an open end and a second plurality of external projections and a spring to bias said closure away from said container. The second plurality of external projections on said container includes a first series of projections having under-notches alternating with a second series of projections without under-notches. Indicia on said closure and container are for selectively engaging the lugs with the projections with under-notches in a child-resistant mode of operation, and engaging the lugs with the projections without under-notches in a non-child resistant mode of operation. In the preferred embodiment, the spring is formed by opposed portions of the closure and the container, one or both of which resiliently deflect to develop the spring force. A separate spring element, such as a spring disk, could be provided between the closure and the container rim, but would be less preferred.

A package in accordance with a second aspect of the present invention includes a closure for attachment to a container. The closure has a skirt with a plurality of lugs and an internal surface. The container has a sidewall terminating in an open end and having a plurality of projections thereon. The plurality of projections include a set of child-resistant and a set of non-child-resistant projections. The child-resistant projections have undersides with notches for receiving the plurality of lugs of the closure, and the non-child-resistant projections have substantially flat undersides for locating against the plurality of lugs of the closure. The sidewall further has a conical surface at the open end for engagement with the internal surface of the closure to seal the package and to resiliently bias the closure away from the container. The internal surface on the closure skirt preferably is conical.

A package in accordance with another aspect of the present invention includes a closure for attachment to a container. The closure includes a base wall and a skirt extending from the base wall. The skirt has a plurality of internal lugs extending radially inwardly and an internal surface between the plurality of lugs and the base wall. The container includes a base, a sidewall extending from the base and terminating in an open end. The sidewall includes a plurality of external projections extending radially outwardly therefrom, and sets of child-resistant and non-child-resistant projections. The child-resistant projections have undersides with notches for receiving the plurality of internal lugs of the closure. The non-child-resistant projections have substantially flat undersides for locating against the plurality of internal lugs of the closure. The sidewall also includes an external conical surface between the plurality of external projections and the open end for engagement with the internal conical surface of the closure for sealing the package and for resiliently biasing the closure away from the container so as to resiliently urge the plurality of internal lugs into the notches of the plurality of child-resistant projections in the child-resistant mode of operation and to resiliently urge the plurality of internal lugs into contact with the undersides of the plurality of non-child-resistant projections in the non-child-resistant mode of operation.

Another aspect of the present invention includes a closure for receipt on a container having a plurality of external projections. The closure includes a base wall, a skirt, and indicia on at least one of the base wall and the skirt. The skirt extends from the base wall and has a plurality of internal lugs extending radially inwardly and an internal surface between the plurality of internal lugs and the base wall for sealingly engaging the container. The indicia are provided on at least one of the base wall and the skirt to facilitate selective engagement of the plurality of internal lugs either with the plurality of external projections of the closure in a child-resistant mode of operation or in a non-child-resistant mode of operation.

A further aspect of the present invention includes a container for cooperation with a closure having a plurality of internal lugs. The container includes a base, and a sidewall extending from the base and terminating in an open end. The sidewall includes a plurality of external projections extending radially outwardly therefrom, and including a set of child-resistant and a set of non-child-resistant projections. The child-resistant projections have undersides with notches for receiving the plurality of internal lugs of the closure. The non-child-resistant projections have substantially flat undersides for locating against the plurality of internal lugs of the closure. The sidewall also includes an external conical surface between the plurality of external projections and the open end for sealing engagement with the closure and for resiliently biasing the closure away from the container so as to resiliently urge the plurality of internal lugs into the notches of the plurality of child-resistant projections in the child-resistant mode of operation and to resiliently urge the plurality of internal lugs into contact with the undersides of the plurality of non-child-resistant projections in the non-child-resistant mode of operation.

In one or more of the preferred embodiments of the invention, there are indicia provided on one or both of the closure and container to facilitate selective engagement of the plurality of lugs of the closure either with the child-resistant projections of the container in a child-resistant mode of operation or with the non-child-resistant projections of the container in a non-child-resistant mode of operation. Moreover, the sets of child-resistant and non-child-resistant projections are circumferentially interspersed around the sidewall of the container. Finally, one or both of the sidewall of the container and the skirt of the closure is radially resiliently flexible and adapted to flex upon engagement of the opposing surfaces of the closure and container for sealing the package and resiliently urging the plurality of lugs into the notches of the child-resistant projections in a child-resistant mode of operation and into contact with the undersides of the non-child-resistant projections in a non-child-resistant mode of operation.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
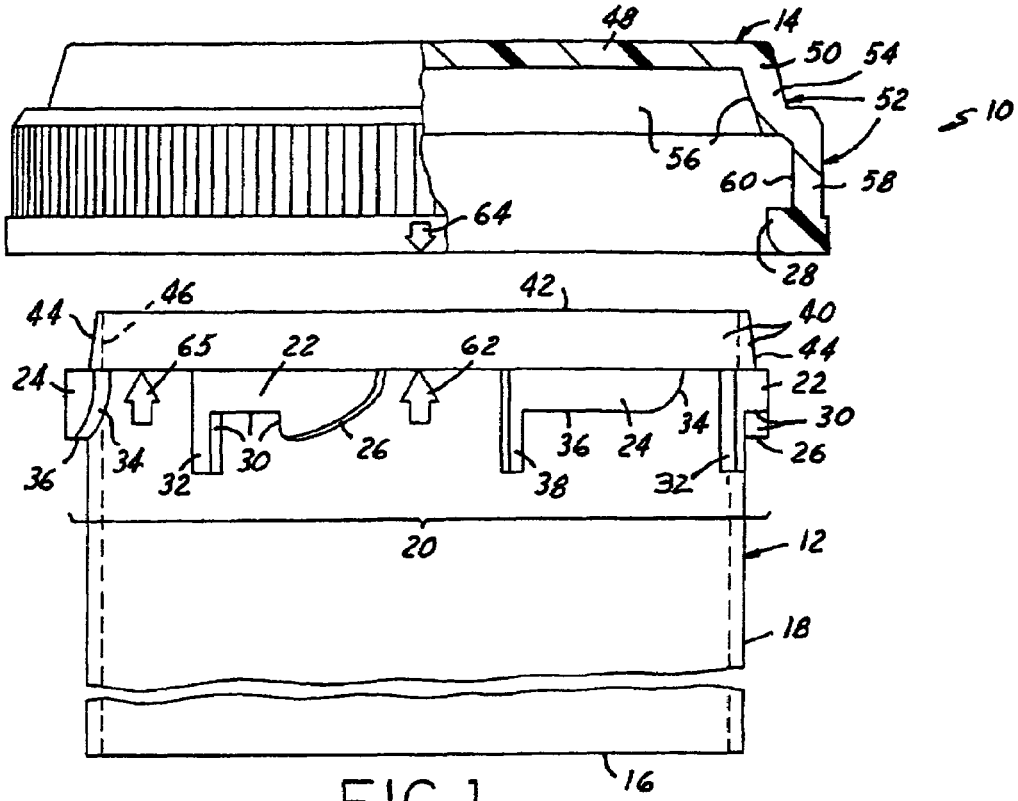
FIG. 1 is a partially sectioned, exploded, elevational view of a closure and a container of a package in accordance with one presently preferred embodiment of the invention, wherein indicia on the closure and container are aligned to facilitate selective engagement of the closure to the container for use of the package in a child-resistant mode of operation.

FIG. 1 illustrates a package 10 in accordance with one presently preferred embodiment of the invention. Package 10 includes a vial or container 12 and a closure 14 secured to container 12 either in a child-resistant mode of operation or in a non-child-resistant mode of operation. As will be discussed in more detail below, the closure 14 is oriented and aligned with respect to the container 12 in preparation for applying the closure 14 to the container 12 in a child-resistant mode of operation.

The container 12 includes a bottom wall 16 that is substantially perpendicular to a longitudinal axis of the container 12 and package 10, and a container sidewall 18 extending upwardly from the bottom wall 16. A circumferential array of locking elements or projections 20 extend radially outwardly near an upper end of the sidewall 18, substantially distal from the bottom wall 16. All of the projections 20 lie in a plane perpendicular to the longitudinal axis of the container 12 and preferably are equidistantly spaced about the circumference of the sidewall 18. As partially depicted in FIG. 1, there are a total of six projections 20, but more or fewer may be used as desired. The array of projections 20 includes a first set or plurality of child-resistant (CR) projections 22, and a second set or plurality of non-child-resistant (NCR) projections 24 that are interspersed or alternate with the first set of projections 22 around the circumference of the container 12.

Each CR projection 22 has a cam surface 26 for camming lugs 28 of the closure 14 underneath the projections 22 and into a downwardly facing pocket or notch 30 for receiving the corresponding locking elements or lugs 28 of the closure 14 in a child-resistant mode of operation. The cam surface 26 and notch 30 define an underside of the projection 24. Each CR projection 22 also includes a circumferential stop element 32 extending in an axial direction along the sidewall 18 of the container 12 for preventing over-rotation of the closure 14 on the container 12.

Likewise, each NCR projection 24 also has a cam surface 34 for camming the lugs 28 of the closure 14 underneath the projections 24, but against a downwardly facing axial stop surface 36 that is substantially flat and is provided for preventing the closure 14 from axially separating from the container 12 once applied thereto. The cam surface 34 and stop surface 36 define an underside of the projection 24. Each NCR projection 24 also includes a circumferential stop element 38 for preventing over-rotation of the closure 14 on the container 12.

A tapered portion 40 of the container sidewall 18 extends upwardly from the plane established by the projections 20. The tapered portion 40 of the container wall 36 that extends upwardly from the projections 20 preferably tapers narrowingly in radial thickness toward an open upper edge or end 42 that is opposite of the bottom wall 16 and that defines and surrounds an open mouth 46 of the container 12. A radially outwardly facing surface 44 of the tapered portion 40 preferably is an external conical surface of revolution, while opposed inner surface or open mouth 46 preferably is substantially cylindrical or an internal straight surface of revolution (ignoring draft angle). (Directional words such as "upwardly" and "downwardly" are employed by way of description and not limitation with respect to the upright orientation of the package 10. Moreover, directional words such as "radial" and "axial" are employed by way of description and not limitation with respect to the central longitudinal axis of the package 10 or container 12, as appropriate.)

Still referring to FIG. 1, the closure 14 includes a base wall 48 that preferably is circular, flat for provision of suitable labeling or the like, continuous, and lying in a plane perpendicular to a longitudinal axis of the closure 14. The base wall 48 includes a radial or circumferential periphery 50 from which extends a skirt 52. The skirt 52 includes a wall portion 54 having an internal surface 56, preferably a conical surface of revolution for purposes to be described below. The skirt 52 also includes a substantially cylindrical wall portion 58 having the plurality of circumferentially spaced lugs 28 extending radially inwardly from an inner surface 60 thereof. The projections 28 may be either solid, as shown, or hollow. Preferably, the lugs 28 are equidistantly spaced, and are three in number in the illustrated embodiment. Any number of lugs 28 may be used, but it is preferable that the number be half the total quantity of container projections 20 or, in other words, the same quantity as each set of the CR and NCR projections 22, 24.

As briefly mentioned above, FIG. 1 illustrates the closure 14 as oriented and aligned with respect to the container 12 in preparation for applying the closure 14 to the container 12 in a child-resistant mode of operation. Accordingly, both the container 12 and the closure 14 are provided with corresponding alignment indicia 62, 64 respectively. The indicia 62, 64 on the container 12 and closure 14 serve to facilitate the selective engagement of the plurality of lugs 28 of the closure 14 with the child-resistant projections 22 of the container 14 in the child-resistant mode of operation. Second indicia 65 on container 12 cooperate with closure indicia 64 for alignment and assembly in a non-child-resistant mode of operation. As just one example, the alignment indicia 62, 64, 65 are provided as raised arrowheads.

Figure 2:
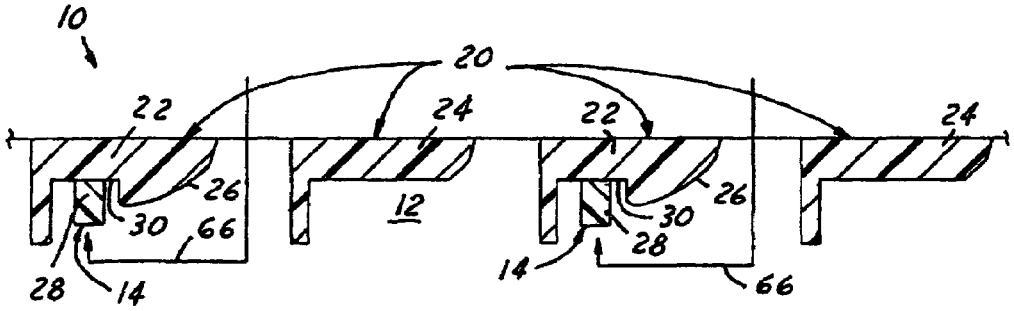
FIG. 2 is a fragmentary, sectional, two-dimensional linear representation of a three-dimensional circumferential portion of the package illustrated in FIG. 1, wherein the closure is received on the container in the child-resistant mode of operation.

To apply the closure 14 to the container 12 in a CR mode of operation, it is desirable to first suitably align the closure indicia 64 with the container CR indicia 62. To apply the closure 14 to the container 12, the skirt 52 of the closure 14 is received over the open end 42 of the container 12, such that the lugs 28 of the closure 14 locate freely between the CR and NCR projections 22, 24, and such that the surface 56 of the wall 54 of the closure 14 initially engages the tapered portion 40, particularly the tapered or conical surface 44 thereof. Continued downward movement of the closure 14 with respect to the container 12 resiliently flexes one or both of the wall 54 of the skirt 52 of the closure 14 and the tapered portion 40 of the sidewall 18 of the container 12. For example, the wall 54 may flex radially outwardly and/or the tapered portion 40 may flex radially inwardly. As depicted in FIG. 1 by the initial alignment of the closure 14 to the container 12, and as best depicted in FIG. 2 by the arrows 66, clockwise rotation of the closure 14 on the container 12 cams the closure lugs 28 under the cam surfaces 26 on the CR projections 22 of the container 12 until the lugs 28 lock into the projection notches 30.

Referring to FIG. 1, the angles of taper of the conical wall 54 of the closure 14 and of the tapered portion 40 of the container 12, and the flexibility of the conical wall 54 and of the tapered portion 40, preferably are such that there is full circumferential sealing engagement between the mating conical surfaces 44 and 56. The sealing engagement may be accomplished by surface engagement or by line contact engagement of the open end 42 of the container 12 with the conical surface 56 of the closure 14. The internal conical surface 56 of the conical wall 56 of the closure 14 thus cooperates with the external conical surface 44 of the tapered portion 40 of the container 12 both to seal the package 10 and to resiliently to urge the closure locking lugs 28 into the container locking notches 30. To remove the closure 14, the closure 14 is manually urged axially downwardly over the container 12 against the spring force between the tapered portion 40 of the container 12 and the conical wall 54 of the closure 14 until the closure lugs 28 clear the projection notches 30, and the closure 14 is then freely turned counterclockwise, whereby the lugs 28 ride up the camming surfaces 26 and pass freely between the projections 22, 24 so that the closure 14 may be separated from the container 12.

Figure 3:
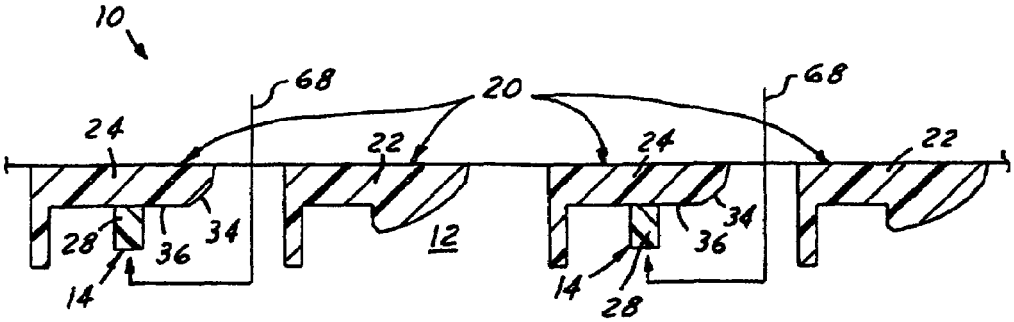
FIG. 3 is a fragmentary, sectional, two-dimensional linear representation of a three-dimensional circumferential portion of the package illustrated in FIG. 1, wherein the closure is received on the container in a non-child-resistant mode of operation.

As shown in FIG. 3, and in contrast to the prior art, the closure 14 need not be inverted for use in the NCR mode. In fact, the non-child-resistant mode of operation is largely the same as the child-resistant mode of operation described above, except for the following differences.

To apply the closure 14 to the container 12 in the NCR mode of operation, it is not desirable to align the closure indicia 64 with the container indicia 65. It is also contemplated that alternative indicia could be supplied to indicate proper alignment for one or both of the NCR and CR mode. For example, the letters NCR could be formed or printed equidistantly around the container 12 adjacent the camming surfaces 34 of the NCR projections 24, while the letters CR could be formed or printed equidistantly around the container 12 adjacent the camming surfaces 26 of the CR projection 22, wherein the arrow indicia 64 of the closure 14 is aligned with the letters of the desired mode. It is also contemplated that any type of appropriate symbology or indicia could be used on one or both of the closure 14 and container 12 to indicate to a user how to use the package 10.

In any case, to attach the closure 14 to the container 12, the skirt 52 of the closure 14 is received over the open end 42 of the container 12, as with the CR mode. But, in the NCR mode, the lugs 28 of the closure 14 locate freely between the CR and NCR projections 22, 24, adjacent the camming surfaces 34 of the NCR projections 24. The closure 14 is rotated clockwise on the container 12 so as to cam the closure lugs 28 under the cam surfaces 34 on the NCR projections 24 of the container 12 until the lugs 28 simply locate under and are axially retained by the axial stop surfaces 36 of the NCR projections 24, as depicted by arrows 68. To remove the closure 14, the closure 14 need not be manually urged axially downwardly over the container 12 as in the CR mode. Rather, the closure 14 is merely turned counterclockwise, whereby the lugs 28 ride up the camming surfaces 34 and pass freely between the projections 22, 24 so that the closure 14 may be separated from the container 12.

In conclusion, the present invention presents one or more of the following advantages with one or more of the embodiments described above. The present invention provides a closure and container package, and a closure and a container for use in such a package, in which the closure can be secured to the container in a child-resistant mode of operation as described above, and in a non-child-resistant mode of operation for use by adults with impaired manual dexterity, for example, when child-resistance is not needed. More specifically, the present invention also provides a package, a container, and a closure of the described character that achieves the non-child-resistant mode of operation without having to invert the closure, such that the package has substantially the same appearance whether in the child-resistant mode or in the non-child-resistant mode of operation. Further, the present invention provides a package, a container, and a closure of the described character that achieve the non-child-resistant mode of operation with little additional material, tooling or labor cost as compared with conventional child-resistant packages. Moreover, the present invention provides a two-piece package of the subject type—i.e., a closure and a container without a separate spring element—in which the spring forces for holding the closure on the container are provided by resilient flexure of either or both of the closure and the container. Finally, the closure and container of the present invention are economical to manufacture the package is readily suited to automated packaging—i.e., is automation friendly.

There have thus been disclosed a closure and container package, a closure, and a container that fully satisfy all of the objects and aims previously set forth. The invention has been disclosed in conjunction with a number of presently preferred embodiments, and additional modifications and variations have also been described. Other modifications and variations will readily suggest themselves to persons of ordinary skill in the art. As noted previously, the preferred embodiments of the invention employ the resilient flexure of the closure skirt and/or the container rim to develop the spring force that biases the closure with respect to the container. However, one or more other spring elements, such as separate spring disks or spring elements on the closure, could be employed without departing form the invention in its broadest aspects. The invention is intended to embrace all such modifications and variations as fall within the spirit and broad scope of the appended claims.

The invention claimed is:

1. A package that includes:

a closure having a skirt with a first plurality of internal lugs, a container having an open end and a second plurality of external projections, a spring between said closure and said container to bias said closure away from said container, said second plurality of external projections on said container including a first series of projections having under-notches alternating with a second series of projections without under-notches, said first plurality of lugs on said closure being equal in number to said first series of projections on said container and equal in number to said second series of projections on said container, such that there are twice as many projections on said container as there are lugs on said closure, and indicia on said closure and container for selectively engaging only said lugs with said projections of said first series of projections with under-notches in a child-resistant mode of operation, and engaging only said lugs with said projections of said second series of projections without under-notches in a non-child-resistant mode of operation.

2. The package set forth in claim 1 wherein said spring is formed by opposed portions of said closure and said container.

3. The package set forth in claim 2 wherein said spring includes a sidewall of said container that is resiliently flexible around said mouth and adapted to flex radially inwardly upon engagement with an internal surface of said closure for resiliently urging said first plurality of lugs into said under-notches of said first series of projections in said child-resistant mode of operation and into contact with undersides of said second series of projections in said non-child-resistant mode of operation.

4. The package set forth in claim 2 wherein said spring includes said skirt of said closure being radially resiliently flexible and adapted to flex radially outwardly upon engagement with an external surface of said container for resiliently urging said first plurality of lugs into said under-notches of said first series of projections in said child-resistant mode of operation and into contact with undersides of said second series of projections in said non-child-resistant mode of operation.

* * * * *